US008308582B2

(12) United States Patent
Tanimoto

(10) Patent No.: US 8,308,582 B2
(45) Date of Patent: Nov. 13, 2012

(54) GOLF CLUB HEAD, AND METHOD FOR MANUFACTURING THE GOLF CLUB HEAD

(75) Inventor: Toshio Tanimoto, Kunitachi (JP)

(73) Assignee: E & F Co., Ltd., Tokyo (JP)

( * ) Notice: Subject to any disclaimer, the term of this patent is extended or adjusted under 35 U.S.C. 154(b) by 320 days.

(21) Appl. No.: 12/527,841

(22) PCT Filed: Dec. 7, 2007

(86) PCT No.: PCT/JP2007/073666

§ 371 (c)(1),
(2), (4) Date: Aug. 19, 2009

(87) PCT Pub. No.: WO2008/102501

PCT Pub. Date: Aug. 28, 2008

(65) Prior Publication Data

US 2010/0048325 A1 Feb. 25, 2010

(30) Foreign Application Priority Data

Feb. 20, 2007 (JP) ..... 2007-039586

(51) Int. Cl.
*A63B 53/04* (2006.01)
*A63B 53/06* (2006.01)

(52) U.S. Cl. ..... 473/335; 473/337; 473/345; 473/346; 473/349

(58) Field of Classification Search ..... 473/324–350, 473/287–292

See application file for complete search history.

(56) References Cited

U.S. PATENT DOCUMENTS

| | | | | |
|---|---|---|---|---|
| 4,214,754 | A * | 7/1980 | Zebelean | 473/346 |
| 5,351,958 | A * | 10/1994 | Helmstetter | 473/346 |
| 5,421,577 | A * | 6/1995 | Kobayashi | 473/335 |
| 5,570,886 | A * | 11/1996 | Rigal et al. | 473/345 |
| 6,595,871 | B2 * | 7/2003 | Sano | 473/342 |
| 6,623,378 | B2 * | 9/2003 | Beach et al. | 473/345 |
| 7,377,861 | B2 * | 5/2008 | Tateno et al. | 473/345 |
| 7,410,428 | B1 * | 8/2008 | Dawson et al. | 473/345 |
| 7,497,788 | B2 * | 3/2009 | Imamoto et al. | 473/335 |
| 2002/0123394 | A1 * | 9/2002 | Tsurumaki | 473/345 |
| 2006/0063609 | A1 * | 3/2006 | Lu | 473/346 |

(Continued)

FOREIGN PATENT DOCUMENTS

| | | |
|---|---|---|
| JP | 59-68569 | 5/1984 |

(Continued)

*Primary Examiner* — Sebastiano Passaniti
(74) *Attorney, Agent, or Firm* — Muncy, Geissler, Olds & Lowe, PLLC

(57) ABSTRACT

To provide a golf club head which is easy-to-hit and which restrains the reduction of flight distance at the time of off-center shot to the minimum without making a sacrifice of the flight distance at the time of sweet spot shot, and a method for manufacturing the golf club head, a golf club head (1) has a hollow structure including a face portion (2) and a body portion (6), the body portion (6) includes a ring-shaped body barrel portion (26) as a front portion, and a tail portion (27) as a rear portion, and the average thickness of the body barrel portion (26) is 0.1 to 0.6 mm, and the mass of the tail portion (27) including a weight portion (8) is 20 to 70 g. The relations $k_b/k_f \leqq 3$ and $2\ \text{kN/mm} \leqq 1/(1/k_b+1/k_f) \leqq 5\ \text{kN/mm}$ are satisfied where $k_f$(kN/mm) is the rigidity of the face portion (2) and $k_b$ (kN/mm) is the rigidity of the body barrel portion (26).

2 Claims, 8 Drawing Sheets

U.S. PATENT DOCUMENTS

| | | | | |
|---|---|---|---|---|
| 2006/0199665 | A1 | 9/2006 | Lo | |
| 2007/0082751 | A1 | 4/2007 | Lo et al. | |
| 2008/0070721 | A1 * | 3/2008 | Chen et al. | 473/346 |

FOREIGN PATENT DOCUMENTS

| | | | |
|---|---|---|---|
| JP | 8-155062 | A | 6/1996 |
| JP | 08-224328 | | 9/1996 |
| JP | 10-263122 | | 10/1998 |
| JP | 2000-5353 | A | 1/2000 |
| JP | 2004-305458 | A | 4/2004 |
| JP | 2004-275751 | | 10/2004 |
| JP | 2005-185750 | A | 7/2005 |
| JP | 2005-192706 | A | 7/2005 |
| JP | 3113023 | | 7/2005 |
| JP | 2005-348895 | | 12/2005 |
| JP | 2006-000461 | | 1/2006 |
| JP | 3120579 | U | 4/2006 |
| JP | 2006-239383 | A | 9/2006 |
| WO | WO 2005/120655 | A1 | 12/2005 |

* cited by examiner

GOLF CLUB HEAD, AND METHOD FOR MANUFACTURING THE GOLF CLUB HEAD

This application is a national stage of International Application No.: PCT/JP2007/073666, which was filed on Dec. 7, 2007, and which claims priority to Japanese Patent Application No.: 2007-039586, which was filed in Japan on Feb. 20, 2007, and which are both herein incorporated by reference.

TECHNICAL FIELD

The present invention relates to a golf club head and a method for manufacturing the golf club head.

BACKGROUND ART

Many golf players desire to carry a golf ball longer distance more surely when they play golf. A golf club from which a long flight distance is expected is mainly a wood-type club (driver, fairway wood and utility), and the club head of the wood-type club is made of materials such as wood, stainless steel, aluminum alloy, titanium alloy and fiber reinforced plastic. Aside from advanced players such as professional golfers and top class amateur players, it is almost impossible for many of general golfers to hit a ball at the center of a face, which achieves a longest flight distance (hereinafter referred to as "sweet spot"), every time. Therefore, a principal target of golf club development in recent years is how to widen a right hitting portion which does not decrease the ball flight distance (hereinafter referred to as "sweet area").

As a method of achieving the principal target, Document 1, for example, discloses a technology to increase the volume of a head for increasing the moment of inertia of the head and to provide a weight in the rear portion of the head for positioning the center of mass thereof rearward, that is, positioning the center of mass away from the face as much as possible when the club head is viewed from above, so as to achieve a small moment of rotation about the center of mass when a ball is hit at a spot out of the sweet spot (hereinafter referred to as "at the time of off-center shots"). Alternatively, Document 2 discloses a configuration in which a high repulsion area on a face portion is increased by combining different metallic materials in a crown, and Document 3 discloses a configuration in which a weight is provided on the inner surface of a crown to reduce the amount of back spin for the purpose of increasing flight distance, and Document 4 discloses a configuration in which the range of the repulsion area of the face portion is adjusted by increasing the rigidity of the crown to a level higher than that of the sole. As described in these documents, various modifications are applied to a crown or, in contrast, various modifications are applied to a sole in publicly known techniques. In addition, Document 5 discloses a configuration in which the coefficient of repulsion is increased by specifying the range of mechanical impedance of a golf club head with respect to the frequency area of the mechanical impedance of a golf ball, this is also known in public.

Document 1: JP-A-10-263122
Document 2: JP-A-2005-348895
Document 3: JP-A-2004-275751
Document 4: JP-A-2006-461
Document 5: JP-A-8-224328

However, the inventions disclosed in Documents 1 to 5 do not necessarily satisfy golfers under the present situation, and there still exists a problem that the flight distance cannot be dramatically improved. Since modification in shape of the golf club head causes various problems in terms of rules, it is desired to develop the golf club which is able to improve the flight distance at a normal shot and further satisfies the golfers without significantly changing the current shape.

DISCLOSURE OF THE INVENTION

Problems to be Solved by the Invention

The present invention was made in order to solve the problem shown above, and it is an object of the present invention to provide a golf club head which is easy-to-hit and in which reduction of flight distance at the time of off-center shots is restrained to the minimum without making a sacrifice of the flight distance at the time of sweet spot shots, and a method for manufacturing the golf club head.

Means for Solving the Problems

A golf club head according to the present invention has a hollow structure including a face portion and a body portion, in which the body portion includes a body barrel portion as a front portion and a tail portion as a rear portion, and the average thickness of the body barrel portion is 0.1 to 0.6 mm and the mass of the tail portion is 20 to 70 g.

The body portion may be made of at least one of Ti, Ti alloy, Al, Al alloy, Mg, Mg alloy and a composite material.

The tail portion may include a weight portion.

The weight portion may be formed integrally with the tail portion.

The weight portion may be able to be post-assembled to the body portion.

At least a part of the body portion may be covered with a surface protecting portion.

The surface protecting portion may be made of a composite material.

The body portion may be formed with a rib on at least one of the inner surface and the outer surface.

A golf club head according to the present invention has a hollow structure including a face portion and a body portion, in which the body portion includes a body barrel portion as a front portion and a tail portion as a rear portion, and the mass of the tail portion is 20 to 70 g, and the relations $k_b/k_f \leqq 3$ and $2\ \text{kN/mm} \leqq 1/(1/k_b+1/k_f) \leqq 5\ \text{kN/mm}$ are satisfied where $k_f$ (kN/mm) is the rigidity of the face portion and $k_b$ (kN/mm) is the rigidity of the body barrel portion.

A method for manufacturing a golf club head according to the present invention which has a hollow structure including a face portion having a face body and a face panel, and a body portion having a body barrel portion as a front portion and a tail portion as a rear portion, includes casting the face body and the body portion integrally, reducing the thickness of the body portion so that the average thickness of the body barrel portion falls within a range from 0.1 to 0.6 mm, increasing the mass of the tail portion so that the mass of the tail portion falls within a range from 20 to 70 g, and joining the face panel to the face body.

The step of casting and the step of increasing the mass of the tail portion may be carried out simultaneously.

An aspect of the present invention is a golf club head comprising a main component having a hollow structure, and a face component joined to the main component so as to close an opening in the main component, wherein the main component is reduced in thickness by a thickness reducing process, and the weight according to the weight reduced by the thickness reducing process is added to a tail portion of the main component.

An aspect of the present invention is a golf club head having a hollow structure comprising a face portion, and a body portion, wherein the face portion includes a face body and a face panel, the face panel is joined to the face body, the body portion is a member integrated with the face body, the body portion is reduced in thickness, and the weight according to the weight reduced by the thickness reduction is added to a tail portion of the body portion.

An aspect of the present invention is a method for manufacturing a golf club head having a hollow structure including a face portion having a face body and a face panel, and a body portion, the method comprising forming a member including the face body and the body portion integrated with each other, reducing the thickness of the body portion, and joining the face panel to the face body, wherein the weight according to the weight to be reduced by the thickness reduction is added to a tail portion of the body portion by arbitrary one or more steps from the step of forming the integrated member to completion of the golf club head.

An aspect of the present invention is a golf club head having a hollow structure comprising a face portion, and a body portion, wherein the body portion includes a body barrel portion as a front portion, and a tail portion as a rear portion, and wherein the tail portion is heavier than the body barrel portion.

An aspect of the present invention is a golf club head having a hollow structure, wherein assuming that a vertically projected shape VP is a shape of a projected image obtained by projecting the golf club head on a horizontal plane in a state in which the golf club head is fixed to a posture of 60 degrees in lie angle, and assuming that a virtual plane P0 is a plane in contact with the center of the face plane, when the golf club head is divided into three portions; a front portion, a middle portion and a rear portion by two dividing planes which are parallel to the virtual plane P0, the two dividing planes dividing a line connecting a front end and a rear end of the vertically projected shape VP equally into three portions, the weight relation among the front portion, the middle portion and the rear portion is: front portion>rear portion>middle portion.

An aspect of the present invention is a golf club head having a hollow structure, wherein assuming that a virtual plane P0 is a plane in contact with the center of a face plane, and assuming that a virtual plane P1 is a plane parallel to the virtual plane P0 and in contact with a rearmost portion of the golf club head, when the golf club head is divided into three portion; a front portion, a middle portion and a rear portion by two dividing planes which are parallel to the virtual plane P0, the two dividing planes dividing a space between the virtual plane P0 and the virtual plane P1 equally into three portions, the weight relation among the front portion, the middle portion and the rear portion is: front portion>rear portion>middle portion.

The golf club head may be formed of at least one of Ti, Ti alloy, Al, Al alloy, Mg and Mg alloy, and a CFRP cover may be adhered to a 30% or more part of the surface of the body portion with adhesive agent.

The golf club head according to the present invention may be a golf club head for drivers, fairway woods or utility clubs.

Another aspect of the present invention is a golf club having the above-described golf club head and the golf club may be provided with the golf club head and a shaft.

A method for manufacturing the golf club head according to the present invention may be a method for manufacturing a golf club head for drivers, fairway woods or utility clubs.

Another aspect of the present invention is a method for manufacturing a golf club in which a golf club head may be manufactured by the above-described method and the golf club head may be connected to a shaft.

According to the invention, the average thickness of the body barrel portion as the front portion of the body portion is 0.1 to 0.6 mm. In other words, the relations $k_b/k_f \leqq 3$ and $2\ \text{kN/mm} \leqq 1/(1/k_b+1/k_f) \leqq 5\ \text{kN/mm}$ are satisfied, where $k_f$ (kN/mm) is the rigidity of the face portion and $k_b$ (kN/mm) is the rigidity of the body barrel portion. Further, the mass of the tail portion as the rear portion of the body portion falls within the range from 20 to 70 g. Therefore, the entire body portion is deflected at the time of shots so that the repulsive force with respect to the ball is increased. Further, when the deflected body portion repels at the time of shots, the entire face portion is pushed out via the body portion by the moment of inertia of the translatory or linear movement of the weight portion. Consequently, easy-to-hit property is achieved, and the reduction of the flight distance at the time of off-center shots is minimized without making a sacrifice of the flight distance at the time of sweet spot shots.

As described hereafter, other aspects of the invention exist. Thus, this summary of the invention is intended to provide a few aspects of the invention and is not intended to limit the scope of the invention described and claimed herein.

DESCRIPTION OF THE SYMBOLS

1, 40, 50, 60 . . . golf club head, 2 . . . face portion, 6 . . . body barrel portion, 8, 42 . . . weight portion, 26 . . . body barrel portion, 27 . . . tail portion, 30 . . . surface protecting portion, 61 . . . rib

BEST MODE OF EMBODYING THE INVENTION

A detailed explanation of the invention will be hereinafter described. The detailed explanation and the accompanying drawings do not limit the invention. Instead, the scope of the invention is limited by claims attached hereto.

Figure 1:
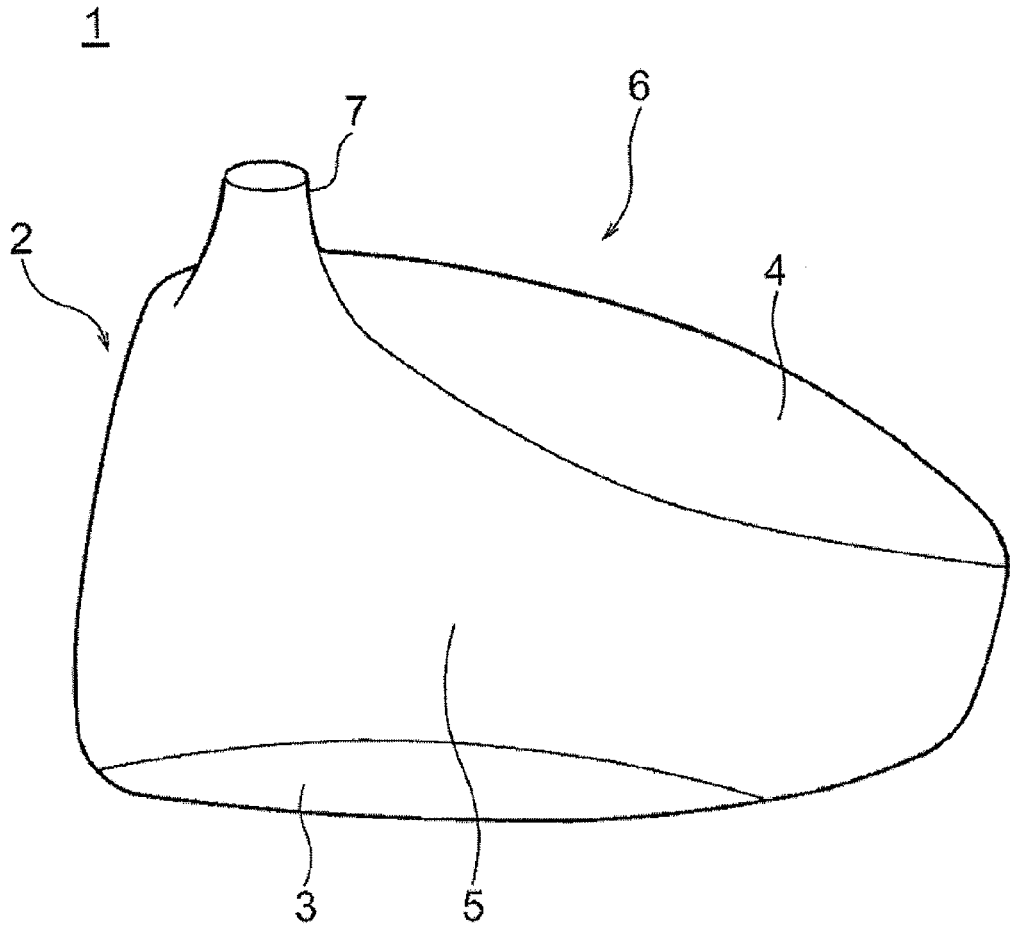
FIG. 1 is a side view of a golf club head according to an embodiment of the present invention.

FIG. 1 is a side view of a golf club head according to an embodiment. A golf club head 1 includes a face portion 2 and a body portion 6, and the body portion 6 includes a sole 3, a crown 4 and a side body 5. The face portion 2 is provided with a neck portion 7 to which a shaft, not shown, is connected. The golf club head 1 has the volume of 400 to 468 cc, and a mass of 185 to 208 g, preferably, of 193 to 203 g. This range of the mass of the golf club head 1 is defined from the fact that a golf club head cannot provide a desirable repulsive force to a ball when hitting the ball if the mass of the golf club head is smaller than 185 g because it cannot overcome the impact of the ball, while the player cannot swing a club easily if the mass of the golf club head is larger than 208 g because it is too heavy.

Figure 2:
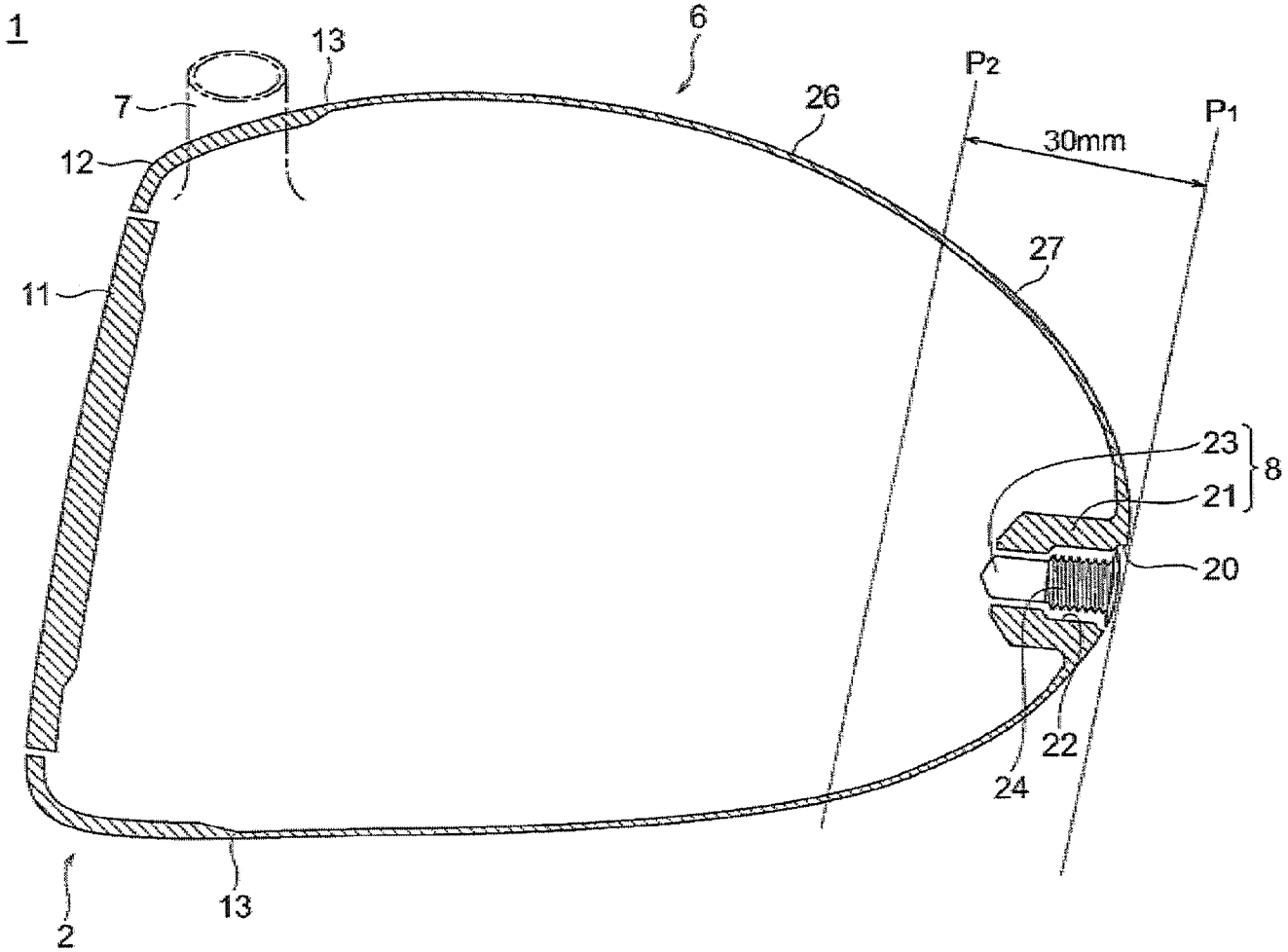
FIG. 2 is a side cross-sectional view of the golf club head according to the embodiment.

FIG. 2 is a cross-sectional view of the golf club head 1.

The face portion 2 includes a plate-shaped face panel 11 having a larger thickness at the center portion than at the peripheral portion, a bowl-shaped face body 12 having a hole in which the face panel 11 is to be fitted, and the neck portion 7. The face panel 11 is made of Ti-4.5Al-3V-2Mo-2Fe alloy, which is one of (α-β) type Ti alloys, and the face body 12 and the neck portion 7 are made of Ti-6Al-4V alloy which is one of (α-β) type Ti alloys. The face panel 11 is fixed to the face body 12 by being welded at the periphery thereof to the face body 12. The neck portion 7 is integrated with the face body 12, or is welded to the face body 12. The thickness of the face body 12 is gradually decreased toward a connecting portion 13 between the face body 12 and the body portion 6 in a tapered manner, and is integrated with the body portion 6. The mass of the face portion 2 including the neck portion 7 is 85 to 130 g, preferably 90 to 110 g, and more preferably 95 to 105 g. Although the face body 12 and the body portion 6 are integrated in this embodiment, they may be cast or forged separately and then joined. Although the face portion 2 includes the face panel 11 and the face body 12 as separate members, the face panel 11 and the face body 12 may be integrally formed by casting or forging. Alternatively, the face panel 11 may have a cup shape in which the entire peripheral portion of the face panel 11 extending to the body side, and the face body may be welded to the peripheral portion. Furthermore, the face body portion may be formed by welding at least two members of the crown, the sole and the side body.

The body portion 6 is made of Ti-6Al-4V alloy and includes a hollow structure. In the body portion 6, the portion on the side of the face portion 2 is defined as a front portion, and the portion on the other side is defined as a rear portion. Assume that a plane extending in parallel to the face panel 11 and coming into contact with the rearmost portion of the body portion 6 is a virtual plane $P_1$, and a plane obtained by moving the virtual plane $P_1$ toward the front portion by 30 mm is a virtual plane $P_2$. When the body portion 6 is cut along the virtual plane $P_2$, a ring-shaped (that is barrel-shaped) body barrel portion 26 as a front portion and a tail portion 27 as a rear portion are separately obtained.

The tail portion 27 is provided with a weight portion 8. The weight portion 8 includes a through hole portion 20 provided on the rear portion of the body portion 6, a substantially cylindrical bolt fixing portion 21 formed with a female thread portion 22 so as to communicate with the through hole 20, and a bolt 23. The bolt 23 is made preferably of a high density material such as tungsten. The bolt 23 is fixed to the bolt fixing portion 21 by inserting the same into the through hole 20 and the bolt fixing portion 21 from the outside of the body portion 6, and engaging a male thread portion 24 of the bolt 23 with the female thread portion 22. The mass of the tail portion 27 including the weight portion 8 is 20 to 70 g and, preferably, 30 to 60 g. Although it is preferable to make the tail portion 27 as heavy as possible, the above range of the mass of the tail portion 27 is defined so as to achieve the range of the mass of the entire golf club head 1 as shown above (185 to 208 g, preferably 193 to 203 g). The weight portion 8 is a part of the tail portion 27 and, as described above, the mass of the tail portion 27 means the total mass including the tail portion 27 and the weight portion 8.

The average thickness of the body barrel portion 26 is 0.1 to 0.6 mm, preferably, 0.2 to 0.45 mm. Here, the reason why the average thickness of the body barrel portion 26 is defined within this range is that the rigidity of the body portion is too low if the thickness is smaller than 0.1 mm, and hence the repulsive force with respect to the ball is not expected at the time of shots and, in addition, it may be depressed by collision with other clubs in a bag during the time other than the time of shots, for example, during transportation. In contrast, when the thickness exceeds 0.6 mm, the weight of the body portion is too much, therefore, the weight of a desirable weight cannot be arranged in the tail portion, and the repulsion of the ball from the body portion cannot be expected since the rigidity of the body portion is too high. Measurement of the average thickness of the body barrel portion 26 is carried out by using, for example, a three-dimensional shape measuring apparatus (Non-contact 3D Digitizer VIVID 9i, Konica Minolta Sensing Inc.). However, the method of measuring the average thickness is not limited thereto, and may be any methods as long as the average thickness can be measured at the same level of accuracy.

Although there exist conventional golf club heads having a crown plate thickness of a range from 0.4 to 0.8 mm, there is no golf club head whose thickness of the portion, which corresponds to the body barrel portion 26 of the golf club head 1 in this embodiment including the sole and the side body as a whole, falls within the range from 0.1 to 0.6 mm. Such conventional golf club heads are directed to improve the strike-out angle or to reduce the amount of back spin by lowering the rigidity of the crown without lowering the rigidity of the sole and the side body so as to direct a face upward at the time of shots, and are directed to achieve higher shots by lowering the center of mass by transferring an excess of weight generated by thinning the crown portion to the sole. However, in these golf club heads, the rigidity of the sole and the side body is increased according to increase in their thickness. That is, these conventional golf club heads are engineered on the basis of the technical idea that the repulsive force of the face portion is improved by enhancing the rigidity of the body portion. Assuming that the sole and the side body have the same thickness as the crown, the golf club as such will suffer from a problem that the flight distance is shortened because the face is not directed upward at the time of shots, or balls cannot be struck high since the low center of mass cannot be achieved. However, since the golf club head 1 in this embodiment is provided with the weight portion 8 in the tail portion 27 to achieve the mass of the tail portion 27 in the range from 20 to 70 g, preferably from 30 to 60 g, therefore the moment of inertia of a translatory movement of the tail portion 27 pushes out the entire face portion 2 via the body barrel portion 26 and hence the above-described problem can be solved. In addition, since the rigidity of the entire body barrel portion 26 is lowered by setting up the average thickness of the body barrel portion 26 in the range from 0.1 to 0.6 mm, preferably from 0.2 to 0.45 mm, deflection of the body barrel portion 26 at the time of shots is increased, and hence the repulsive force with respect to the ball is improved. In other words, the present invention is achieved on the basis of a technical idea to lower the rigidity of the body portion, which is completely opposite from the principle of development of the conventional golf clubs. Furthermore, since the thickness of the entire body barrel portion 26 is small, the body barrel portion 26 achieves a light-weight mass in comparison with the conventional golf club heads, whereby this invention carries out the mass of the tail portion 27 in the range from 20 to 70 g, which is heavier than the conventional golf club heads, while maintaining the entire mass of the golf club head 1 within the range from 185 to 208 g. If the mass of the tail portion 27 is less than 20 g, the effect of pushing out the body barrel portion by the tail portion is abruptly lowered. In contrast, even when the mass of the tail portion 27 exceeds 70 g, the above-described effect is not lowered, but the mass of the tail portion 27 does not substantially exceed 70 g considering that the range of the mass of the driving golf club head 1 is from 185 to 208 g. In other words, the upper limit value of the mass of the tail portion 27 is not determined on the basis of the presence or absence of the effect described above, but determined on the basis of the possibility of realization.

Subsequently, an example of a method for manufacturing the golf club head 1 according to this embodiment will be described.

The body portion 6 and the face body 12 are integrally manufactured with Ti-6Al-4V alloy by casting in such a manner that the through hole 20 and the bolt fixing portion 21 are included in the rear portion (step of casting). When they are formed only by casting as the conventional golf club head, it is difficult to set the average thickness of the body barrel portion 26 to the range from 0.1 to 0.6 mm and, considering the flow during casting, an average thickness is approx. 0.8 mm at best. Therefore, the thickness of the cast body portion 6 is reduced by chemical milling. Etching liquid for the chemical milling, for example, a liquid including hydrofluoric acid, nitric acid, chromic acid, surface active agent is filled in the hollow portion in the interior of the body portion 6 made of Ti-6Al-4V alloy. The concentration of the etching liquid and the period required for etching the interior of the body portion 6 are the matters to be adjusted as needed based on the average thickness of the cast body barrel portion 26, its final average thickness, etc. However, reduction of the thickness is carried out selectively by masking portions whose reduction of thickness is not desired, such as the tail portion 27 including the bolt fixing portion 21 or the face body 12, with anti-acid resin or rubber (step of reducing thickness). After having reduced the thickness, the mass of the tail portion 27 is increased so that mass of the tail portion falls within the range from 20 to 70 g by fixing the bolt 23 to the bolt fixing portion 21 (step of increasing), and the face panel 11 made of Ti-4.5Al-3V-2Mo-2Fe alloy is joined by welding to the face body 12 (step of joining), whereby the golf club head 1 is obtained.

Figure 4:
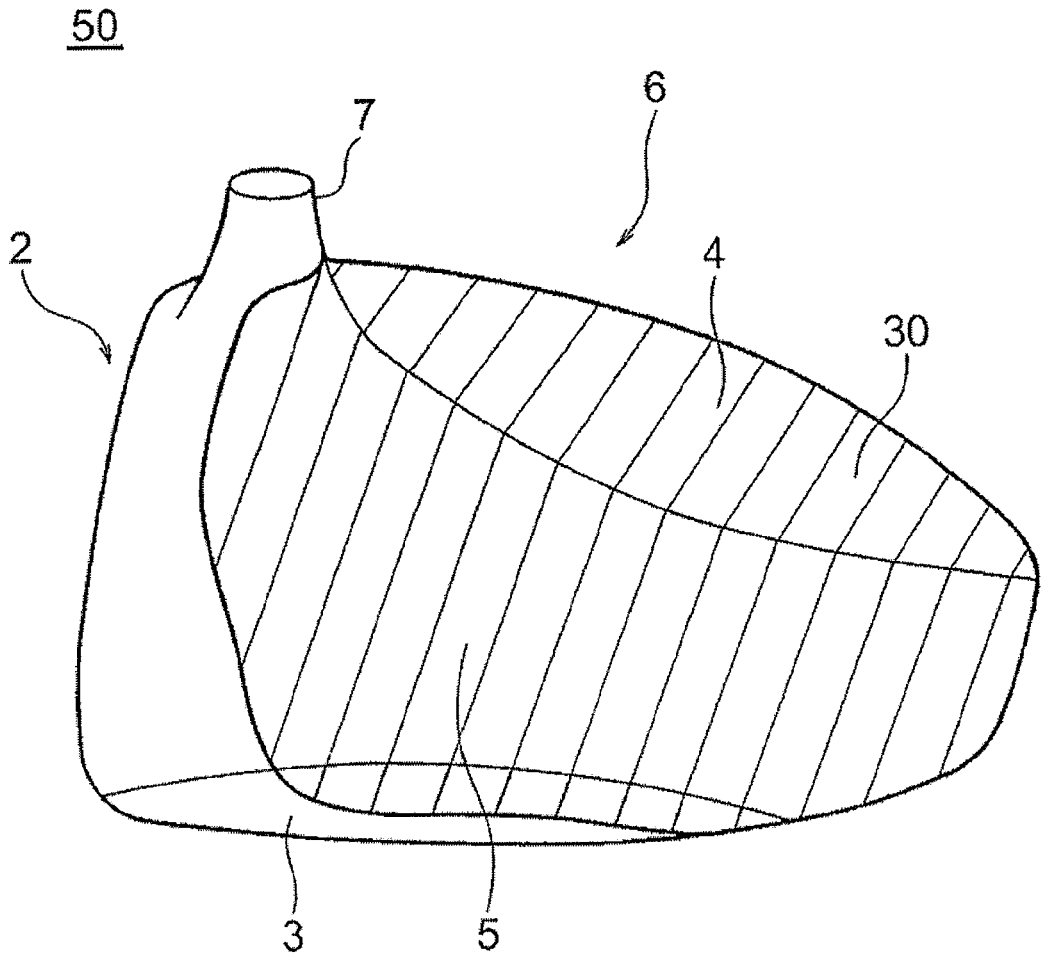
FIG. 4 is a side view of another modified golf club head according to the embodiment.

In the method of manufacturing descried above, the chemical milling is applied to the inner surface of the body portion 6 for reducing the thickness. However, it is also possible to reduce the thickness by soaking the body portion 6 in the etching liquid and applying the chemical milling to the outer surface of the body portion 6. The method of reducing the thickness is not limited to the chemical milling, and other methods such as grinding may also be employed. In the case that a through hole is formed in the body barrel portion 26, the thickness of the portion other than the hole does not change, but the average thickness of the body barrel portion 26 as a whole is reduced. Therefore, the average thickness of the body barrel portion 26 may be reduced to 0.1 to 0.6 mm by forming the through holes in the body barrel portion 26. The shape and the number of the through hole are arbitrary and, in an extreme case, the entire portion of the body barrel portion 26 may be formed in a lattice pattern. When forming the through holes in this manner, it is necessary to cover the entire body portion with a surface protecting portion 30 (see FIG. 4) described later, so that the through holes cannot be viewed from the outside.

In this embodiment, the golf club head 1 has the hollow structure having the face portion 2 and the body portion 6, the body portion 6 includes the ring-shaped body barrel portion 26 as the front portion and the tail portion 27 as the rear portion, the average thickness of the body barrel portion 26 is from 0.1 to 0.6 mm, and the mass of the tail portion 27 is from 20 to 70 g. In this configuration, the rigidity of the body barrel portion 26 may be reduced in comparison with the conventional golf club heads, and the mass of the tail portion 27 including the weight portion 8 may be increased by an amount corresponding to the reduction in mass of the body barrel portion 26. Consequently, the deflection of the body barrel portion 26 at the time of shots is increased, and the repulsive force with respect to the ball is increased. Since the rigidity is higher in the face portion 2 than in the body barrel portion 26, irregular deformation (twist) of the face portion 2 is restrained even at the time of off-center shots, and hence the reduction of flight distance is reduced. In addition, when the deflected body portion repels at the time of shots, the entire face portion 2 is pushed out via the body barrel portion 26 by the moment of inertia of the translatory or linear movement of the tail portion 27, and as the mass of the tail portion 27 is large, the repulsive force with respect to the ball is increased correspondingly. Therefore, easy-to-hit property is achieved, and the reduction of the flight distance at the time of off-center shots is minimized without making a sacrifice of the flight distance at the time of sweet spot shots.

In this embodiment, Ti-4.5Al-3V-2Mo-2Fe alloy is used for the face panel 11, and Ti-6Al-4V alloy is used for the body portion 6 and the face body 12. However, the invention is not limited to these materials. Other ($\alpha$-$\beta$) type Ti alloys, or $\beta$ type Ti alloys such as Ti-15V-3Cr-3Sn-3Al and Ti-15V-6Cr-4Al may also be employed, and pure Ti or composite materials including Ti and other materials are also applicable. The invention is not limited to the materials including Ti alloys, and pure Al, Al alloy, pure Mg, Mg alloy, and composite materials such as carbon fiber reinforced plastic (CFRP) or glass fiber reinforced plastic (GFRP) may be employed. The composite materials here include Ti alloy, Al alloy, Mg alloy, CFRP, GFRP, etc. containing nano carbon material such as the carbon nanotube or fullerene. Alternatively, at least two of Ti alloy, Al alloy, Mg alloy and a composite material may also be employed.

Figure 3:
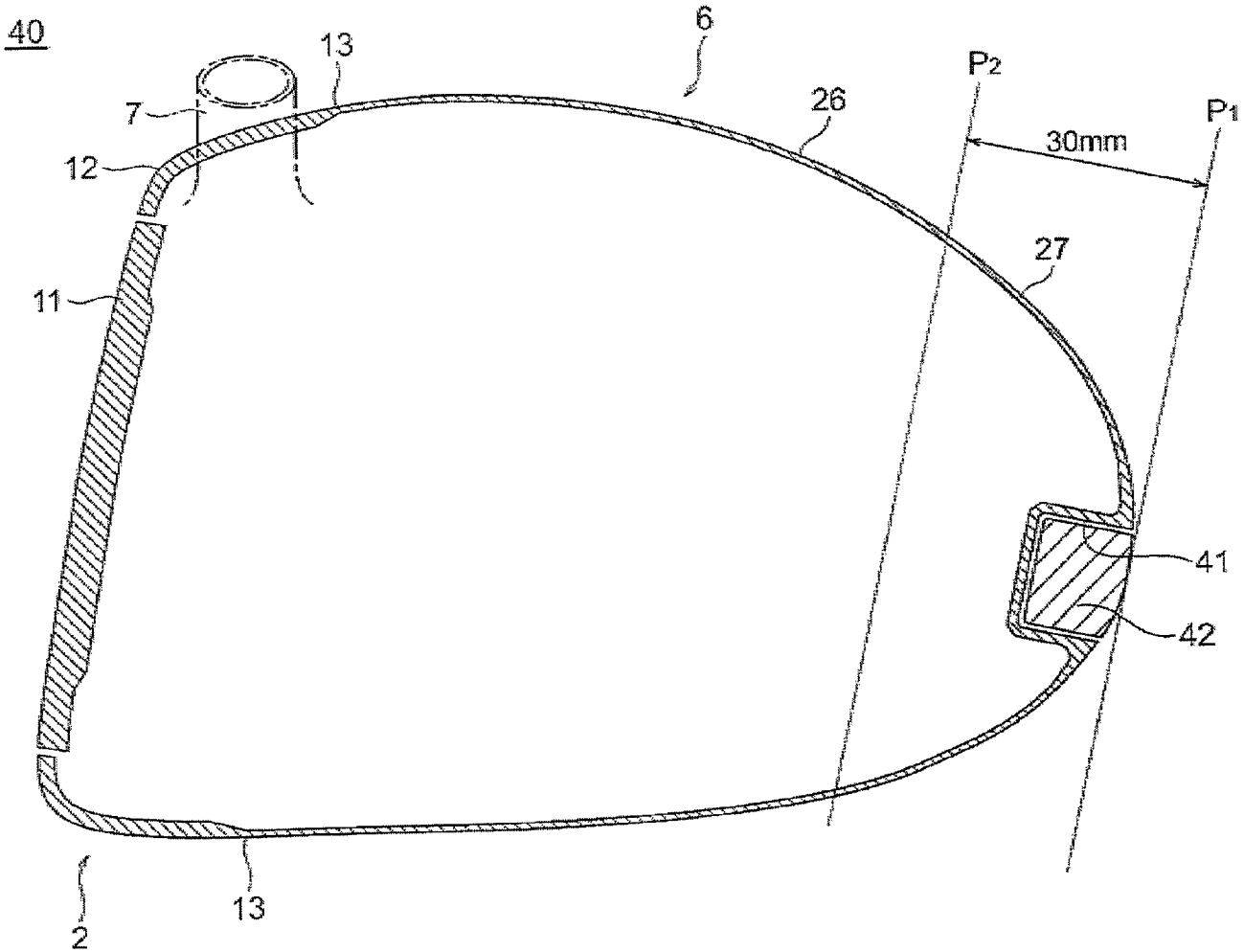
FIG. 3 is a side view of a modified golf club head according to the embodiment.

In this embodiment, the weight portion 8 includes the through hole 20, the bolt fixing portion 21 and the bolt 23. However, the invention is not limited thereto. The weight portion 8 may be of any type as long as the mass of the tail portion 27 falls within the specified range. Therefore, it may be integrally formed with the tail portion 27 or may be attached later to the tail portion 27. For example, as shown in FIG. 3, in a golf club head 40, a recess 41 is formed on the tail portion 27, and a weight portion 42 made of tungsten is provided so as to be accommodated in the recess 41. The mass of the tail portion 27 including the weight portion 42 can be set up to 20 to 70 g, preferably, to 30 to 60 g by adjusting the mass of the weight portion 42.

The mass range as described above may be achieved by manufacturing the tail portion 27 with a high density material such as tungsten with increased thickness. In other words, the mass range as described above may be achieved only by the tail portion 27 without the weight portion 8 or 42. In this case, the step of integrally casting the face body and the body portion and the step of increasing the mass of the tail portion so that the mass of the tail portion falls within the range from 20 to 70 g are carried out simultaneously.

Since the golf club head 1 according to this embodiment has a less thickness over the entire portion of the body barrel portion 26 than the conventional golf club heads, the strength is lowered correspondingly. However, the term "strength" here does not mean the strength with respect to the impact at the time of shots, but means that the body barrel portion 26 is apt to be depressed, for example, by collision with other clubs in a bag when it is inserted into the club bag together with other clubs. Therefore, as shown as a hatched part in FIG. 4, the surface protecting portion 30 made of CFRP may be provided at a part of the sole 3, the crown 4 and the side body 5 of a golf club head 50. The surface protecting portion 30 is not limited to be made of CFRP. However, since the mass of the tail portion 27 needs to be reduced by the amount corresponding to the mass of the surface protecting portion, it is preferable to employ a material which is as small as possible in mass and has a protecting performance. In view of this point, a composite material containing CFRP is optimal. The range covered by the surface protecting portion 30 needs not to be the range shown in FIG. 4, and may be the entire part of the body portion 6 or a part thereof. In this case, the thickness of the surface protecting portion 30 made of CFRP is preferably from 0.2 to 1.0 mm, more preferably, from 0.3 to 0.6 mm, so as not to impair the original function of the body portion 6 that the entire part thereof deflects.

Figure 5:
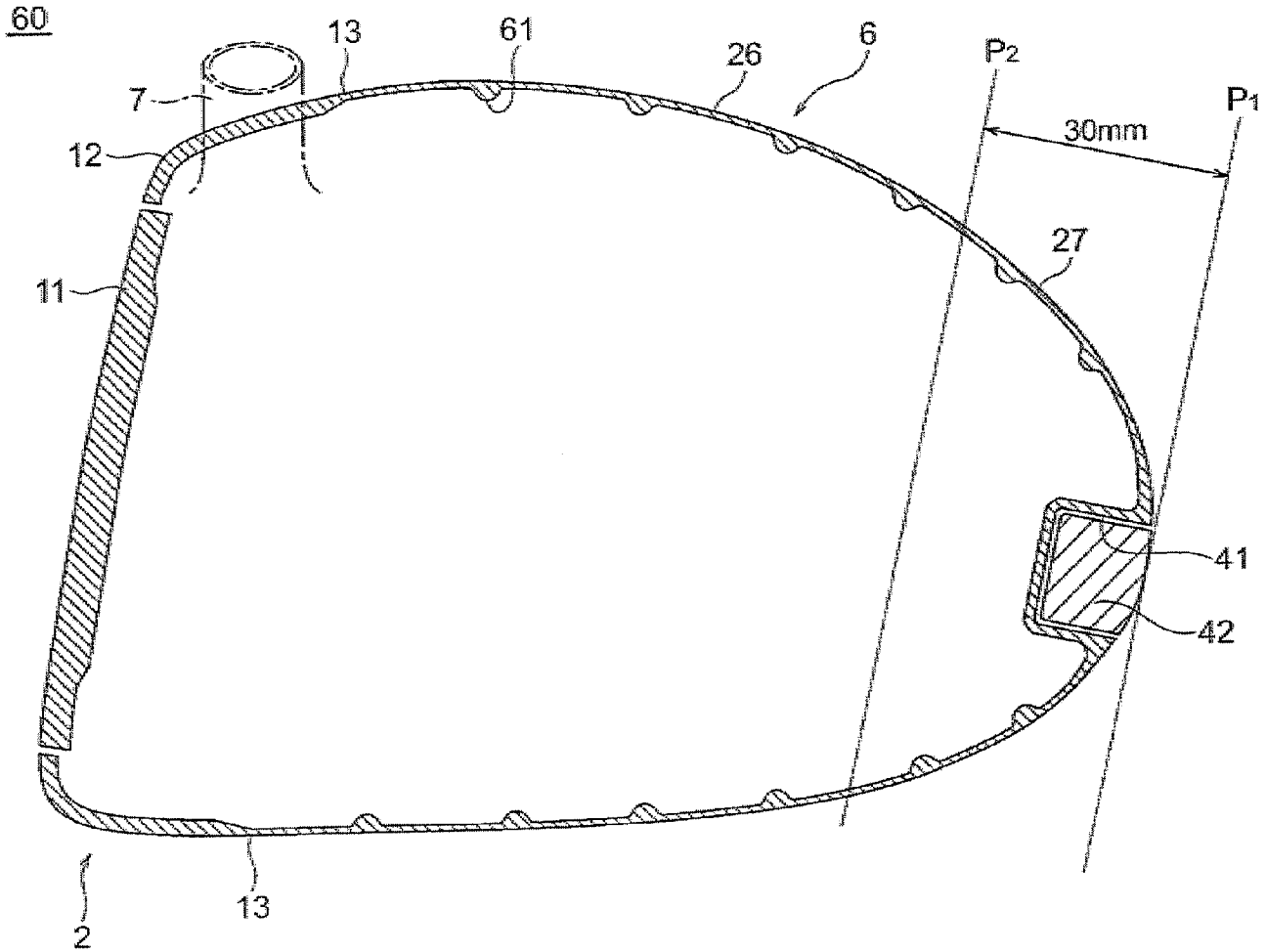
FIG. 5 is a side cross-sectional view of another modified golf club head according to the embodiment.
Figure 6:
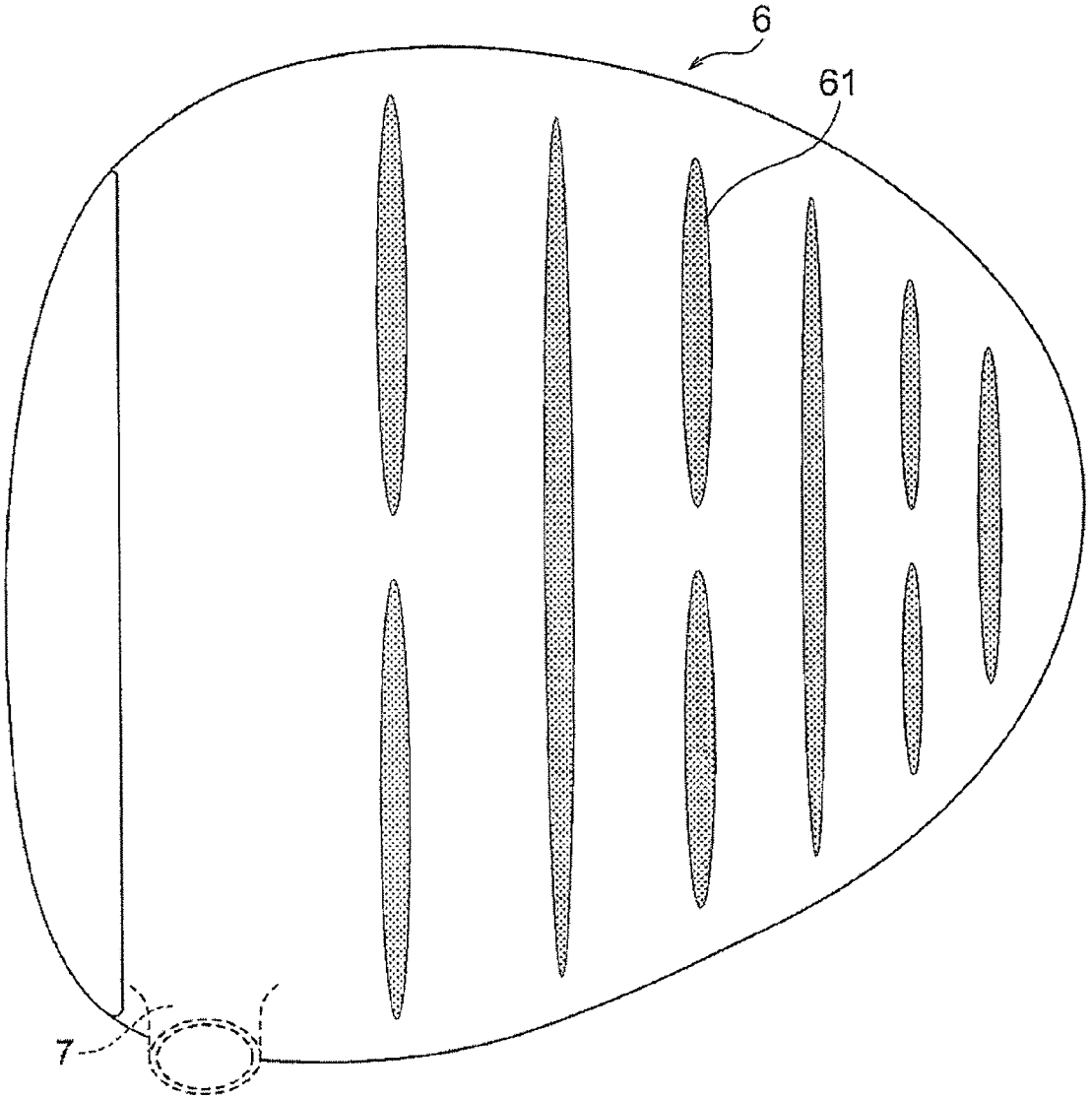
FIG. 6 is a plan view of a part of the inner surface of a body portion in another modified golf club head according to the embodiment.

The body portion 6 may be provided with ribs in order to improve the above-described strength of the body barrel portion 26. As shown in FIG. 5, the body portion 6 of a golf club head 60 is formed with ribs 61 on the inner surface of the body portion 6 so as to project from the inner surface. The ribs 61 are formed on the inner surface of the body portion 6 in a stripe pattern as shown in FIG. 6. However, the ribs do not have to be provided in the stripe pattern, and may be provided in various patterns including a lattice pattern. Provision of the ribs is not limited to the inner surface of the body portion 6, and may be on the outer surface, or on both the inner surface and the outer surface. When the ribs are provided on the body portion 6, the mass of the body barrel portion 26 is increased by an amount corresponding to the ribs. Therefore, the mass of the tail portion 27 must be reduced. Therefore, when providing the ribs, the least number and the least size of ribs should be provided.

As a method of providing ribs on at least one of the inner surface and the outer surface of the body portion 6, ribs may be formed by building up on at least one of the inner surface and the outer surface of the body portion 6, or ribs may be formed by masking positions where the ribs are to be formed, and applying the chemical milling on at least one of the inner surface and the outer surface of the body portion 6, thereby reducing the thickness of the portion around the masking. In this embodiment, the body portion 6 is manufactured by casting, however, it may be manufactured by forging. In this case, in consideration of welding, at least 0.7 mm thickness of the joint portion of the thin plate is needed, and hence the joint portions may be utilized as ribs. It is also possible to use a clad member composed of a flat thin plate and thin plate components formed into the rib shape.

When the ribs are provided on at least one of the inner surface and the outer surface of the body portion 6, the term "average thickness of the body barrel portion 26" means the entire thickness including the ribs. With the three-dimensional shape measuring apparatus, the entire thickness of the body barrel portion including the ribs can be measured by data processing which averages the ribs and make the entire body barrel portion 26 have a uniform or constant thickness.

There is a case in which a weight is attached to a sole of the golf club head, and also a decorative badge or resin or rubber is attached. These members are normally attached to the golf club head later. Referring these members to as post-assembly accessories, a post-assembly accessory mounting portion such as a female screw portion is formed on the body portion of the golf club head for mounting the post-assembly accessories to the golf club head. In such a case, the post-assembly accessories are demounted, and data of the solid shape of the post-assembly accessory mounting portion is deleted by the three-dimensional shape measuring apparatus, so that it is possible to measure the average thickness of the body barrel portion 26 without the post-assembly accessories and the post-assembly accessory mounting portion.

"Application to Drivers, Fairway Woods and Utility Clubs"

The present invention is applicable to arbitrary golf club heads having a hollow structure. The golf club head may be a head for drivers, and may be for fairway woods, and may be for utility clubs (the utility club includes utility woods and utility iron clubs). The golf club head for drivers has the volume of 400 cc to 468 cc, and has a mass of 185 to 208 g, preferably, 193 g to 203 g. The golf club head for fairway woods has the volume of 100 cc to 230 cc and a mass of 200 g to 240 g. The golf club head for utility clubs has the volume of 100 cc to 230 cc and a mass of 200 g to 250 g.

The characteristic configuration of the present invention is the same for all the arbitrary golf club heads having a hollow structure. Therefore, the characteristic configuration of the present invention is the same for any one of the drivers, the fairway woods and the utility clubs. That is, the weight of the tail portion is 20 to 70 g and, preferably, 30 to 60 g. The average thickness of the body barrel portion is 0.1 to 0.6 mm and, preferably, 0.2 to 0.45 mm. When the rigidity of the face portion is represented by $k_f$ (kN/mm) and the rigidity of the body barrel portion is represented by $k_b$ (kN/mm), the relation; $k_b/k_f \leqq 3$, and 2 kN/mm$\leqq 1/(1/k_b+1/k_f) \leqq$ 5 kN/mmm is satisfied.

"Boundary Between Body Barrel Portion and Tail Portion"

(1) As described above, the virtual plane P1 is set to be parallel to the face panel 11 and comes into contact with the rearmost portion of the body portion 6. Then, the virtual plane P2 is set to be parallel to the virtual plane P1 and positioned 30 mm before the virtual plane P1. The virtual plane P2 is used as a boundary between the body barrel portion and the tail portion.

Here, although the surface of the face panel 11 can be actually a curved surface, the curvature of curvature is very small. Therefore, the surface of the face panel 11 is substantially flat, and is approximated to a plane which comes into contact with the center point of the face panel 11. The virtual planes $P_1$ and $P_2$ may extend in parallel to the above-described plane of the face panel 11. More specifically, the center point of the face panel 11 is generally at the center between the left and right ends of the face panel 11 and the center between the vertical ends thereof. The plane of the face panel 11 is a horizontal plane passing through the center point when the face panel 11 is arranged so that the center point is located at the top of the spherical surface. In other words, the plane of the face panel 11 is a plane vertical to a line which connects the center point of the surface of the face panel 11 and the center of the spherical surface of the face panel 11.

(2) The present invention is applicable to arbitrary golf club heads having a hollow structure, and hence is applicable to drivers, fairway woods and utility clubs. When considering these arbitrary clubs, the preferably position of the virtual plane P2 (the preferable boundary between the body barrel portion and the tail portion) is represented as a) and b) shown below.

a) In the case of Drivers: The virtual plane P2 is a plane parallel to the virtual plane P1 positioned at 30 mm before the virtual plane P1.

b) In the case of Clubs other than Drivers: A plane of the face panel 11 is represented by P0. The virtual plane P2 is a plane parallel to the virtual plane P1 positioned on the front side of the virtual plane P1 by 25% of the distance between the plane P0 and the virtual plane P1 (the distance between the virtual plane P2 and the virtual plane P1 is 25% of the distance between the plane P0 and the virtual plane P1).

The boundaries described above are expressed in a different way between drivers and other clubs. The preferable boundary (virtual plane P2) which is applicable to arbitrary clubs is expressed as follows. The virtual plane P2 is a plane parallel to the virtual plane P1 and positioned on the front side of the virtual plane P1, and the distance between the virtual plane P1 and the virtual plane P2 is (a) or (b) which is shorter; (a) 30 mm, (b) 25% of the distance between the plane P0 and the virtual plane P1.

(3) According to the present invention, the average thickness of the body barrel portion 26 is 0.1 to 0.6 mm, and preferably, 0.2 to 0.45 mm. However, referring to FIG. 2, the thickness of the tail portion 27 (the thickness of a portion behind the virtual plane P2 (boundary)) seems to be the same as the body barrel portion 26. This is to be understood as follows.

In the scope of the present invention, the tail portion 27 is defined to have the mass of 20 to 70 g, preferably, 30 to 60 g as described above. However, the thickness of the tail portion 27 is not limited. Therefore, as shown in FIG. 2, the thickness of the front portion of the tail portion 27 may be the same as the average thickness of the body barrel portion 26. That is, the thin range of the body barrel portion 26 may be continued to the tail portion 27. Also, the thickness of the tail portion 27 may increase toward the rear. What is required in the present invention is that the body barrel portion 26 satisfies the condition of the thickness, and the tail portion 27 satisfies the condition of the mass.

"Boundary Between the Face Portion and the Body Portion (Body Barrel Portion)"

The joint portion 13 shown in FIG. 2 corresponds to the boundary between the face portion 2 and the body portion 6 (body barrel portion 26). The preferable boundary between the face portion and the body portion is expressed as a) and b) shown below. Here, the boundary between the face portion and the body portion is defined as a virtual plane P3. The plane of the face panel 11 is defined as the plane P0.

a) In the case of Drivers: The virtual plane P3 is a plane parallel to the plane P0 positioned at 20 mm behind the plane P0.

b) In the case of Clubs other than Drivers: The virtual plane P3 is a plane parallel to the plane P0 positioned at 15 mm behind the plane P0.

The boundaries described above are expressed in a different way between the drivers and other clubs. The preferable boundary (virtual plane P3) which is applicable to arbitrary clubs is expressed as follows. The virtual plane P3 is a plane parallel to the plane P0 of the face panel and positioned on the rear side of the plane P0, and the distance between the plane P0 and the virtual plane P3 is (a) or (b) which is shorter; (a) 20 mm, (b) 20% of the distance between the plane P0 and the virtual plane P1.

"Average Thickness, Rigidity and Mass and Measurement Thereof"

In the present invention, the average thickness of the body barrel portion 26 is defined, and the average thickness is the average thickness of the entire portion. Even though the average thickness of a part of the body barrel portion 26 falls within the range of the thickness in the present invention, such configuration does not correspond to the present invention. For example, when the average thickness of the crown 4 portion falls within the range of the thickness in the present invention but the average thickness of the entire body barrel portion 26 is out of the range of the thickness in the present invention, such configuration does not correspond to the present invention, and hence it is considered that the effects of the present invention are not achieved.

In the present invention, the rigidity kf of the face portion and the rigidity kb of the body barrel portion are values obtained by dividing the vertical load by displacement. In other words, the values of rigidity kf, kb are values corresponding to the spring constant. This will be described in conjunction with the method of measuring rigidity.

When measurement of the body barrel portion, the tail portion and the face portion is actually carried out, these portions are separated by being cut off. In order to prevent or restrain the influence on the result of measurement, the smaller cutting width (the width of the portion removed by being cut, cutting margin) is preferable. The cutting width is set to, for example, 3 mm. More specifically, for example, the portion of 1 mm in width including the boundary is removed by being cut off. Furthermore, the respective cut surfaces are polished so as to remove a portion of 1 mm in width.

As regards the golf club head to which the present invention is applied, the results of measurement are substantially the same irrespective of whether the cut surface is parallel to the surface of the face panel 11 or vertical to the horizontal plane in the actual measurement. Therefore, considering easiness of measurement, the cut surface may be vertical to the horizontal plane, and the vertical surface may be used as an approximate boundary plane. Even though the boundary plane (in particular, the boundary plane between the face portion and the body portion) is not a flat plane, a plane parallel to the face panel or a plane vertical to the horizontal plane may be used as the approximate boundary plane, and cutting or separation may be done along the approximate boundary plane. Further, in cases such as the measurement of rigidity, it is preferably to use a suitable jig according to the shape and the angle of both end surfaces to be measured.

"Weight Portion of Tail Portion"

In FIG. 2, the weight portion 8 of the tail portion 27 includes the bolt 23 as the weight. The material of the weight is, for example, tungsten. The material of the weight may be resin including metal powder mixed therein. The material of the weight may be titan or titan alloy (post-assembly or casting). The weight may be other metal of a high specific gravity. The weight may be resin combined with metal particles of a high specific gravity such as tungsten or copper.

In FIG. 3, the weight portion 42 is provided. The material of the weight portion 42 may be of various types of material as the bolt 23. The weight portion 42 was an example of the post-assembly weight in the present invention. The bolt 23 is also an example of the post-assembly weight. The term "post-assembly weight" means a separate weight, and is a weight to be attached to the tail portion 27.

"Casting Process and Mass Increasing Process"

As described above, in the method for manufacturing a golf club head according to the present invention, the casting process and the mass increasing process (a process to increase the mass of the tail portion) may be carried out simultaneously. To carry out these processes simultaneously means that the casting is carried out to obtain a shape in which the tail portion having a mass within a range from 20 to 70 g. In other words, by setting the shape such as the thickness of the tail portion so that the mass falls within the range from 20 to 70 g, the two processes are achieved simultaneously.

"Surface Protecting Portion 30"

In the present invention, the surface protecting portion 30 is provided on the body portion. The surface protecting portion 30 has an important role as follows.

As is understood from the description given thus far, it is important that the rigidity of the body barrel portion 26 is low in the present invention. Therefore, the surface protecting portion 30 is required to prevent generation of local depression due to contact with other clubs without increasing the rigidity of the body barrel portion 26 (as much as loosing the effect of the invention). According to the present invention, such requirement is achieved by the surface protecting portion 30 which is composed of a thin cover.

In other words, the surface protecting portion 30 is a member (thin cover) having a thickness which maintains the rigidity obtained over the range of the average thickness of the body barrel portion 26 and, simultaneously, prevents generation of local depression in association with the lowering of the strength due to the setting of the range of the average thickness. More specifically, the surface protecting portion 30 is formed of CFRP, and is a cover having a thickness from 0.2 to 1.0 mm, preferably, 0.3 to 0.6 mm. The surface protecting portion 30 is set at a portion which comes into contact with other golf clubs when the golf club 1 is stored in a bag. The surface protecting portion 30 is provided so as to cover at least the crown 4. The surface protecting portion 30 may cover part of the body portion 6, and may cover the entire body portion 6. The surface protecting portion 30 may be bonded to the body portion 6.

As described above, in order to achieve the setting of the average thickness according to the present invention, the body barrel portion 26 may have a lattice pattern. In this case, the framework in the lattice pattern may be covered by the thin cover such as carbon. The pitch of the lattice pattern is, for example, 1 cm. The entire body barrel portion 26 may be configured in this manner.

According to the golf club head 1 in this embodiment, with the provision of the surface protecting portion 30 configured as described above, the effect obtained by lowering the rigidity of the body is maintained and, simultaneously, the depression of the body is prevented. In particular, when it is carried in the bag, the depression is effectively prevented.

The surface protecting portion 30 reduces the sound generated when hitting a ball. The sound may be excessive depending on the shape of the golf club head 1. In this case, reduction of the sound is expected by the provision of the surface protecting portion 30. Vibrations of the sound are absorbed by the cover resin and adhesive agent.

The surface protecting portion 30 is able to reduce unevenness in thickness of the body barrel portion 26. In the present invention, the thickness of the body barrel portion 26 is reduced by chemical milling or the like. In a thickness reducing process, the thickness may be significantly small locally. In such a case, the cover is mounted as the surface protecting portion 30, and the cover thickness is added to the body thickness in the present invention. The cover may reduce the ratio of the maximum thickness with respect to the minimum thickness, and hence the degree of unevenness may be reduced. In the thickness reducing process, a through hole (pin hole) may be formed partially on the body barrel portion 26. In this case, the through hole is covered by the cover, and the appearance is improved.

The carbon cover is also used for the golf club head in the prior arts. However, the carbon cover in the prior arts has a configuration to close an opening formed in the crown. Conventionally, the component of the crown is replaced with carbon to generate the excessive weight, and the excessive weight is arranged in the sole to lower the center of gravity. Conventionally, the opening in the crown is provided to reduce the relative rigidity of the crown with respect to the sole. Such configuration in the prior arts is intended to increase the gear effect and to reduced the amount of spin of the ball. In this manner, the carbon cover in the prior arts has the configuration specifically to close the opening in the crown, and hence is provided for the object and function different from those in the present invention, whereby the advantage of the present invention are not obtained.

Being different from the cover in the prior arts as described above, the surface protecting portion 30 in the present invention is superimposed on the body portion 6. For example, the carbon cover is adhered on the titanium alloy body. Accordingly, the present invention provides the above-described advantages that are not be achieved by the carbon cover in the prior art.

In order to achieve the above-described advantages, the golf club head preferably has the following configuration. That is, the golf club head is formed of at lest one of Ti, Ti alloy, Al, Al alloy, Mg and Mg alloy. Then, the CFRP cover is adhered to a 30% or more part of the surface of the body portion with adhesive agent. The golf club head may have a sealed hollow structure. The sealed hollow structure may have a pin hole (pin hole is allowed). The golf club head may have a hollow structure having a plurality of through holes of a size from 10 $mm^2$ to 200 $mm^2$.

"Rib"

As shown in FIG. 5 and FIG. 6, the body portion 6 is provided with the ribs, whereby the strength of the body barrel portion 26 is improved. As understood from FIG. 6, the ribs may be provided part of the inner surface or the outer surface of the body barrel portion 26.

"Other Aspects"

(1) An aspect of the present invention is a golf club head having a main component having a hollow structure and a face component joined to the main component so as to cover an opening in the main component, in which the main component is reduced in thickness by the thickness reducing process, and the weight according or corresponding to the weight reduced by the thickness reducing process is added to a tail portion of the main component. In the example of the above-described embodiment, the main component corresponds to a member having the face body portion and the body portion integrated with each other, and the face component corresponds to the face panel. Alternatively, the face component may be a cup face having a cup-shape, and the main component may be a portion behind the cap face. The thickness reducing process may be chemical milling. The addition of the weight to the tail portion may be achieved by increasing the thickness of the tail portion. The increased thickness may be milled by the thickness reduction such as the chemical milling and result in the required weight. The weight such as a bolt may be added to adjust the weight of the tail portion after having reduced in thickness. When this configuration is achieved, the weight of the tail portion is increased and the rigidity of the body is reduced. Therefore, the object of the present invention described above is achieved, and hence the advantages of the present invention are obtained.

(2) An aspect of the present invention is a golf club head having a hollow structure including a face portion and a body portion, in which the face portion includes a face body and a face panel, the face panel is joined to the face body, the body portion is a member integrated with the face body, the body portion is reduced in thickness, and the weight according or corresponding to the weight reduced by the thickness reduction is added to a tail portion of the body portion.

The body portion may be casted integrally with the face body. An integrated member comprising the face portion and the body portion may be formed by welding a plurality of members. Each component to be welded may be a casted part, may be a forged part, and may be a member formed by pressing a plate member. The thickness of the body portions may be reduced by chemical milling, and the chemical milling may be applied at least one of the inner surface and the outer surface of the body portion.

The body portion may be formed by pressing a thin plate member having predetermined thickness without employing the chemical milling.

The body portion may include at least two components joined to each other. Each component may be a component reduced in thickness at a predetermined portion by the chemical milling in advance. The chemical milling may be applied after joint.

Addition of the weight to the tail portion may be realized by increasing the thickness of the tail portion. The increased thickness may be milled by the thickness reduction such as the chemical milling and the required weight may be obtained as a result. In addition, the weight such as the bolt may be added to adjust the weight of the tail portion after having reduced in thickness.

When this configuration is achieved, the weight of the tail portion is increased and the rigidity of the body barrel portion is reduced. Therefore, the object of the present invention described above is achieved, and the advantages of the present invention described above are obtained.

An example of a preferable method for manufacturing the golf club head in the aspect shown above will be described. (i) A head having the opening in the face portion is formed by casting of Ti-6AL-4V. (ii) The head is placed at a predetermined angle such that the face opening is oriented upward. (iii) Acid is filled until a predetermined liquid level in the interior thereof and chemical milling is carried out. (iv) Adjustment of the amount of chemical milling (the amount corresponding to the weight reduction) is controlled by the time of chemical milling. When the weight portion (or part) having a predetermined weight is installed from the beginning, the weight portion is protected with masking. When the weight portion is also reduced together with the body, a rather large weight portion is arranged, and not masked. The amount of the chemical milling is on the order of 35 g to 45 g. The amount of the chemical milling is set according to the type of the head. (v) The face panel is welded. (vi) CFRP is adhered with adhesive agent. (vii) The whole head is finished. (viii) Suitable machine screw from among machine screws of different weights is selected, and the total weight is finally adjusted.

(3) An aspect of the present invention is a golf club head having a hollow structure comprising a face portion, and a body portion, wherein the body portion includes a body barrel portion as a front portion, and a tail portion as a rear portion, and wherein the tail portion is heavier than the body barrel portion. When this configuration is achieved, the weight of the tail portion is increased and the rigidity of the body is reduced. Therefore, the object of the present invention described above is achieved, and hence the advantages of the present invention are obtained.

(4) An aspect of the present invention is a golf club head having a hollow structure, wherein assuming that a vertically projected shape VP is a shape of a projected image obtained by projecting the golf club head on a horizontal plane in a state in which the golf club head is fixed to a posture of 60 degrees in lie angle, and assuming that a virtual plane P0 is a plane in contact with the center of the face plane, when the golf club head is divided into three portions; a front portion, a middle portion and a rear portion by two dividing planes which are parallel to the virtual plane P0, the two dividing planes dividing a line connecting a front end and a rear end of the vertically projected shape VP equally into three portions, the weight relation among the front portion, the middle portion and the rear portion is: front portion>rear portion>middle portion. For example, the weight of the entire head is 190 to 202 g, the weight of the front portion is 100 g, the weight of the middle portion is 42 g, and the weight of the rear portion is 42 to 60 g. When this configuration is achieved, the weight of the tail portion is increased and the rigidity of the body is reduced. Therefore, the object of the present invention described above is achieved, and hence the advantages of the present invention are obtained.

(5) An aspect of the present invention is a golf club head having a hollow structure, wherein assuming that a virtual plane P0 is a plane in contact with the center of a face plane, and assuming that a virtual plane P1 is a plane parallel to the virtual plane P0 and in contact with a rearmost portion of the golf club head, when the golf club head is divided into three portion; a front portion, a middle portion and a rear portion by two dividing planes which are parallel to the virtual plane P0, the two dividing planes dividing a space between the virtual plane P0 and the virtual plane P1 equally into three portions, the weight relation among the front portion, the middle portion and the rear portion is: front portion>rear portion>middle portion. When this configuration is achieved, the weight of the tail portion is increased and the rigidity of the body is reduced. Therefore, the object of the present invention described above is achieved, and hence the advantages of the present invention are obtained.

EXAMPLES

Examples and Comparative Examples

In order to confirm the effect of the golf club heads according to the present invention, test shots were conducted with golf club heads according to the embodiment (Examples 1 to 6), and golf club heads which do not belong to the technical scope of the present invention (Comparative Examples 1 to 4) in a manner described later. Table 1 shows the configurations, the rigidity of the body barrel portions ($k_b$), and the rigidity of the face portions ($k_f$) of the golf club heads respectively in Examples 1 to 6 and Comparative Examples 1 to 4.

TABLE 1

| | AVERAGE THICKNESS OF FACE PANEL [mm] | AVERAGE THICKNESS OF BODY BARREL PORTION [mm] | MASS OF TAIL PORTION [g] | $k_f$ [kN/mm] | $k_b$ [kN/mm] | $K_b/k_f$ [—] | $1/(1/k_b + 1/k_f)$ [kN/mm] |
|---|---|---|---|---|---|---|---|
| EXAMPLE 1 | 2.7 | 0.21 | 35 | 3.6 | 7.4 | 2.1 | 2.4 |
| EXAMPLE 2 | 2.8 | 0.34 | 40 | 4.1 | 8.9 | 2.2 | 2.8 |
| EXAMPLE 3 | 2.9 | 0.48 | 50 | 5.2 | 11.2 | 2.2 | 3.6 |

TABLE 1-continued

| | AVERAGE THICKNESS OF FACE PANEL [mm] | AVERAGE THICKNESS OF BODY BARREL PORTION [mm] | MASS OF TAIL PORTION [g] | $k_f$ [kN/mm] | $k_b$ [kN/mm] | $K_b/k_f$ [—] | $1/(1/k_b + 1/k_f)$ [kN/mm] |
|---|---|---|---|---|---|---|---|
| EXAMPLE 4 | 3.1 | 0.42 | 55 | 3.2 | 9.2 | 2.9 | 2.4 |
| EXAMPLE 5 | 2.5 | 0.15 | 45 | 2.8 | 7.1 | 2.5 | 2.0 |
| EXAMPLE 6 | 2.8 | 0.58 | 52 | 7.2 | 13.2 | 1.8 | 4.7 |
| COMPARATIVE EXAMPLE 1 | 2.1 | 0.50 | 15 | 2.8 | 10.2 | 3.6 | 2.2 |
| COMPARATIVE EXAMPLE 2 | 2.8 | 0.63 | 35 | 3.2 | 10.4 | 3.3 | 2.4 |
| COMPARATIVE EXAMPLE 3 | 2.0 | 0.25 | 75 | 2.2 | 6.2 | 2.8 | 1.6 |
| COMPARATIVE EXAMPLE 4 | 3.7 | 0.72 | 20 | 8.1 | 14.1 | 1.7 | 5.1 |

<Method of Measuring Average Thickness>

A method of measuring average thickness of the face portion and the body barrel portion of the golf club heads according to Examples 1 to 6 and Comparative Examples 1 to 4 will be described.

The measurement of the average thickness was carried out after having finished the test shots carried out in a manner described later. The golf club heads each were separated into the face portion and the body portion, and the body portion was cut into the body barrel portion and the tail portion at the position described in the embodiment (virtual plane $P_2$). However, in a case of a structure in which the weight portion extends relatively long in the body portion toward the face portion, there is considered a case in which part of the weight portion intersects the virtual plane $P_2$, and in such a case, the entire weight portion was regarded as a part of the tail portion without cutting the part of the weight portion along the virtual plane $P_2$. Cutting was carried out by a laser cutting method so as not to generate distortion and so as to bring the cross-sections into tight contact with each other in a plane. An grindstone or abrasive wheel cutting method or a water jet cutting method may also be employed.

The average thickness of the face panel was measured with the three-dimensional shape measuring apparatus (Non-contact 3D Digitizer VIVID 9i, Konica Minolta Sensing Inc.) with the face panel removed from the face body. The thickness of the face panel was not necessarily uniform including the face panel 11 according to the embodiment of the present invention. In this case, the average thickness of the face panel was calculated by carrying out data processing so as to make the entire face panel have a uniform or constant thickness by the three-dimensional shape measuring apparatus.

The average thickness of the body barrel portion was measured using the three-dimensional shape measuring apparatus. The method of measuring in the case in which the ribs are formed or the post-assembly accessories are provided on the body barrel portion is as described above.

<Method of Measuring Rigidity>

A method of measuring the rigidity of the face portion and the body barrel portion of the golf club heads according to Examples 1 to 6 and Comparative Examples 1 to 4 will be described.

The rigidity of the face portion ($K_f$) was measured in the following method. The face portion was placed at a standstill on a horizontal surface plate (surface table) with the face panel directed upward. The face portion was clamped with a die assembly having a sufficiently large plane which apply a uniform load entirely to the face portion. In this case, it is important to set the surface plate on the lower side and the die assembly in parallel to each other. A load was applied to a sweet spot of the face panel via a punch with a universal tensile and compressive testing machine (AG-250kNE, Shimadzu Corporation) and the load was gradually increased. Accordingly, a load-displacement line was obtained, and the rigidity of the face portion was obtained from the inclination of the line.

The rigidity of the body barrel portion ($k_b$) was measured in the following method. The body barrel portion was placed on the horizontal surface plate at a standstill with one of the cross-section plane with respect to the face portion and the cross-section plane with respect to the tail portion which was smaller in opening area faced upward. The body barrel portion was clamped by a die assembly having a sufficiently large plane which apply a uniform load entirely to the body portion, a load was applied to the body barrel portion by the universal tensile and compressive testing machine described above, and the load was gradually increased. In this case, it was important to set the surface plate on the lower side and the die assembly in parallel to each other. Accordingly, a load-displacement line was obtained, and the rigidity of the body barrel portion was obtained from the inclination of the line.

<Method of Test Shots>

Test shots were conducted with golf clubs formed by attaching shafts of the same standard respectively to the golf club heads according to Examples 1 to 6 and Comparative Examples 1 to 4, using a shot robot (SHOT ROBO V, Miyamae Co., Ltd.) at head speeds of 40 m/s and 50 m/s, respectively, to measure the initial ball speed. The test shots were carried out under the conditions that the ball was hit at the sweet spot of the each golf club head and that the ball was hit at positions deviated from the sweet spot toward the toe and the heel respectively by 10 mm and 20 mm at the respective head speeds to measure the initial ball speed. The results are shown in Table 2 and Table 3.

TABLE 2

| | HEAD SPEED | | | |
|---|---|---|---|---|
| | 40 m/s | | 50 m/s | |
| | INITIAL BALL SPEED [m/s] | FLIGHT DISTANCE [m] | INITIAL BALL SPEED [m/s] | FLIGHT DISTANCE [m] |
| EXAMPLE 1 | 54.9 | 224 | 67.7 | 271 |
| EXAMPLE 2 | 52.8 | 226 | 66.9 | 272 |
| EXAMPLE 3 | 54.1 | 224 | 68.6 | 267 |
| EXAMPLE 4 | 54.3 | 223 | 67.4 | 273 |
| EXAMPLE 5 | 53.8 | 222 | 66.7 | 269 |
| EXAMPLE 6 | 54.9 | 220 | 68.1 | 264 |
| COMPARATIVE EXAMPLE 1 | 50.9 | 208 | 64.8 | 251 |
| COMPARATIVE EXAMPLE 2 | 52.0 | 214 | 64.2 | 253 |
| COMPARATIVE EXAMPLE 3 | 51.8 | 212 | 65.1 | 254 |
| COMPARATIVE EXAMPLE 4 | 51.4 | 208 | 64.3 | 253 |

TABLE 3

| | DEVIATION OF SHOT POSITION FROM SWEET SPOT (+: DEVIATION TOWARD TOE, −: DEVIATION TOWARD HEEL) | | | |
|---|---|---|---|---|
| | +20 mm | +10 mm | −10 mm | −20 mm |
| | AMOUNT OF CHANGE IN FLIGHT DISTANCE WITH RESPECT TO THE SHOT AT SWEET SPOT [m] | | | |
| EXAMPLE 1 | −10 | −4 | −6 | −10 |
| EXAMPLE 2 | −9 | −3 | −4 | −8 |
| EXAMPLE 3 | −8 | −3 | −2 | −9 |
| EXAMPLE 4 | −10 | −5 | −4 | −9 |
| EXAMPLE 5 | −9 | −4 | −1 | −8 |
| EXAMPLE 6 | −7 | −3 | −4 | −9 |
| COMPARATIVE EXAMPLE 1 | −12 | −6 | −7 | −14 |
| COMPARATIVE EXAMPLE 2 | −14 | −6 | −8 | −17 |
| COMPARATIVE EXAMPLE 3 | −13 | −7 | −6 | −13 |
| COMPARATIVE EXAMPLE 4 | −16 | −8 | −8 | −14 |

In a case in which the ball was hit at the sweet spot at the head speed of 40 m/s, when the average thickness of the body barrel portion was within the range from 0.1 to 0.6 mm, the initial ball speed was within the range from 52.8 to 54.9 m/s. In contrast, when the average thickness of the body barrel portion was not within the range from 0.1 to 0.6 mm, the initial ball speed was 50.9 to 52.0 m/s. In the same manner, in a case in which the head speed was 50 m/s, the initial ball speed was 66.7 to 68.6 m/s in the range of the present invention, while it was 64.2 to 65.1 m/s in cases out of the range of the present invention. In the case in which the thickness of the body barrel portion was within the range of the present invention, the ball flight distance was larger than the case out of the range of the present invention corresponding to the initial ball speed.

Figure 7:
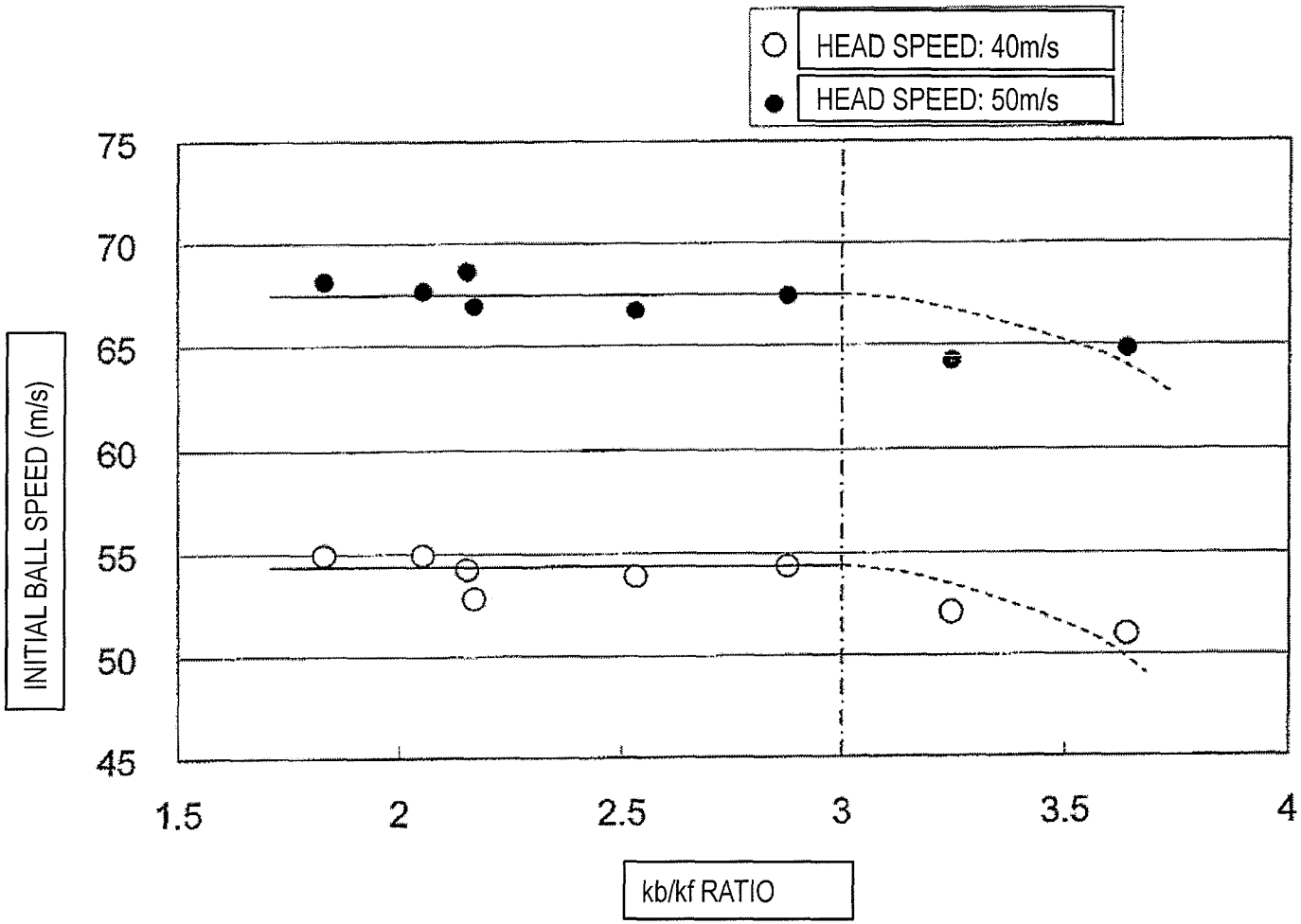
FIG. 7 is a drawing showing the result of test shots.
Figure 8:
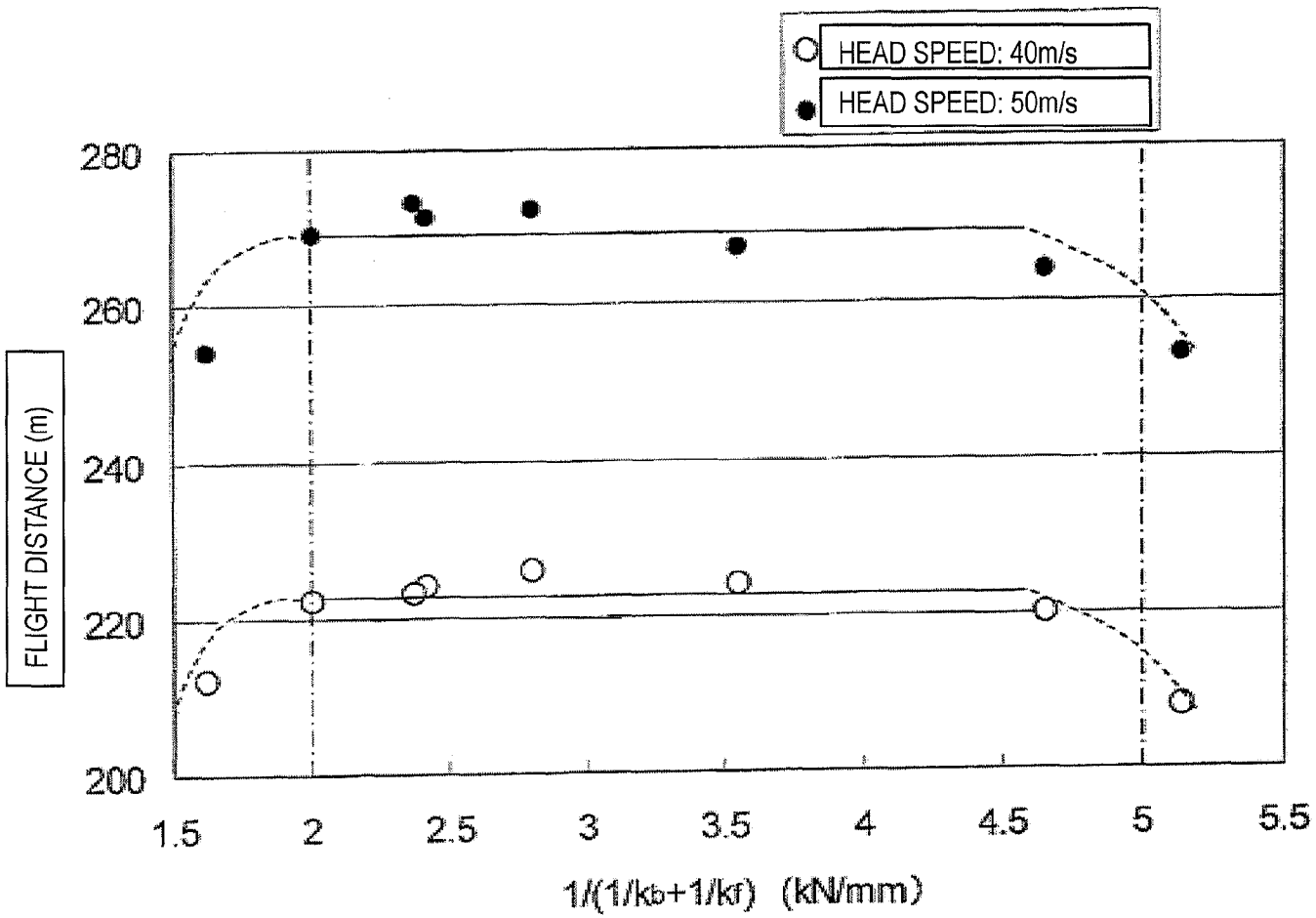
FIG. 8 is another drawing showing the result of test shots.

FIG. 7 and FIG. 8 show the influence of the rigidity of the face portion and the body barrel portion on the test shot result at the sweet spot. FIG. 7 shows the influence of the value $k_b/k_f$ on the initial ball speed, and it is understood that initial ball speeds of 52.8 m/s or higher (when the head speed is 40 m/s) and of 66.7 m/s or higher (when the head speed is 50 m/s) are obtained when the ratio $k_b/k_f$ is 3 or less. FIG. 8 shows the influence of $1/(1/k_b+1/k_f)$, a parameter representing a spring constant of the entire head, on the ball flight distance, and it is understood that ball flight distances of 220 m or longer (when the head speed is 40 m/s) and 264 m or longer (when the head speed is 50 m/s) are achieved when the parameter falls in a range between 2 to 5 inclusive, preferably, between 2 and 4.5 inclusive.

It is also understood that the flight distance when the shot spot was deviated by 10 mm from the sweet spot with respect to the flight distance when the ball was hit at the sweet spot was such that lowering of the flight distance was 1 to 6 m with the parameter within the above-described range, and was increased to 6 to 8 m with the parameter out of the above-described range, and the flight distance when the shot spot was deviated by 20 mm from the sweet spot was such that lowering of the flight distance was 7 to 10 m with the parameter within the above-described range, and was significantly increased to 12 to 17 m with the parameter out of the above-descried range.

Therefore, in other words, the golf club head according to the present invention preferably has the mass of the tail portion from 20 to 70 g, preferably, from 30 to 60 g, and satisfies relations $k_b/k_f \leqq 3$ and $2\ \text{kN/mm} \leqq 1/(1/k_b+1/k_f) \leqq 5\ \text{kN/mm}$.

The preferred embodiments of the invention conceivable at the present point have been explained. It is understood that various modifications to the embodiments are possible. It is intended that the appended claims include all such modifications that are within the true spirit and scope of the invention.

INDUSTRIAL APPLICABILITY

The present invention can provide a golf club head which is easy-to-hit and in which reduction of flight distance at the time of off-center shots is restrained to the minimum without making a sacrifice of the flight distance at the time of sweet spot shots.

The invention claimed is:

1. A golf club head having a hollow structure;

wherein assuming that a vertically projected shape VP is a shape of a projected image obtained by projecting the golf club head on a horizontal plane in a state in which the golf club head is fixed to a posture of 60 degrees in lie angle, and assuming that a virtual plane P0 is a plane in contact with the center of the face plane, when the golf club head is divided into three portions; a front portion, a middle portion and a rear portion by two dividing planes which are parallel to the virtual plane P0, the two dividing planes dividing a line connecting a front end and a rear end of the vertically projected shape VP equally into three portions, the weight relation among the front portion, the middle portion and the rear portion is:

front portion>rear portion>middle portion.

2. A golf club head having a hollow structure;

wherein assuming that a virtual plane P0 is a plane in contact with the center of a face plane, and assuming that a virtual plane P1 is a plane parallel to the virtual plane P0 and in contact with a rearmost portion of the golf club head, when the golf club head is divided into three portion; a front portion, a middle portion and a rear portion by two dividing planes which are parallel to the virtual plane P0, the two dividing planes dividing a space between the virtual plane P0 and the virtual plane P1 equally into three portions, the weight relation among the front portion, the middle portion and the rear portion is:

front portion>rear portion>middle portion.

* * * * *